US007175304B2

(12) United States Patent
Wadia et al.

(10) Patent No.: US 7,175,304 B2
(45) Date of Patent: Feb. 13, 2007

(54) INTEGRATED LOW PROFILE DISPLAY

(75) Inventors: Bahar N. Wadia, Bartlett, IL (US); David W. Caldwell, Holland, MI (US)

(73) Assignee: Touchsensor Technologies, LLC, Wheaton, IL (US)

( * ) Notice: Subject to any disclaimer, the term of this patent is extended or adjusted under 35 U.S.C. 154(b) by 0 days.

(21) Appl. No.: 10/764,170

(22) Filed: Jan. 22, 2004

(65) Prior Publication Data

US 2004/0228145 A1 Nov. 18, 2004

Related U.S. Application Data

(60) Provisional application No. 60/443,651, filed on Jan. 30, 2003.

(51) Int. Cl.
*F21V 7/04* (2006.01)

(52) U.S. Cl. ..... 362/241; 362/560; 362/800

(58) Field of Classification Search ..... 363/560, 363/558, 241, 249, 247, 276, 800; 200/600; 362/560, 559, 558, 555, 241, 249, 247, 276, 362/800, 235, 336, 243, 244, 246, 307, 311, 362/26, 23, 28, 245, 237
See application file for complete search history.

(56) References Cited

U.S. PATENT DOCUMENTS

| | | | | |
|---|---|---|---|---|
| 4,254,453 | A * | 3/1981 | Mouyard et al. | 362/240 |
| 4,345,308 | A * | 8/1982 | Mouyard et al. | 362/332 |
| 5,226,723 | A * | 7/1993 | Chen | 362/241 |
| 5,594,222 | A * | 1/1997 | Caldwell | 200/600 |
| 6,310,611 | B1 | 10/2001 | Caldwell | |
| 6,320,282 | B1 | 11/2001 | Caldwell | |
| 6,345,903 | B1 * | 2/2002 | Koike et al. | 362/249 |
| 6,598,988 | B1 * | 7/2003 | Noll et al. | 362/26 |
| 6,652,128 | B2 * | 11/2003 | Misaras | 362/488 |
| 6,809,470 | B2 * | 10/2004 | Morley et al. | 313/500 |

FOREIGN PATENT DOCUMENTS

| | | | |
|---|---|---|---|
| DE | 10 99 403 B | | 2/1961 |
| DE | 1099403 | * | 2/1961 |
| EP | 0 884 786 A | | 12/1998 |
| FR | 1 585 392 | * | 3/1981 |
| FR | 2 651 356 A | | 3/1991 |
| GB | 1 585 392 A | | 3/1981 |

* cited by examiner

*Primary Examiner*—Sandra O'Shea
*Assistant Examiner*—Bao Q. Truong
(74) *Attorney, Agent, or Firm*—Jenner & Block LLP

(57) ABSTRACT

A panel, such as a component carrier or substrate, is provided with one or more penetrations. A light source associated with a surface of the panel and the corresponding end of each penetration provides light to the interior of the penetration, which guides the light to the other end of the penetration and corresponding surface of the panel. The penetration can be coated with a reflective material to improve its performance as a light guide. Alternatively or additionally, the penetration can be filled with a refractive material. A diffuser can be provided to diffuse light exiting the penetration. The light sources provides light to selected penetrations on demand such that the penetrations function as displays or elements of a display.

58 Claims, 1 Drawing Sheet

INTEGRATED LOW PROFILE DISPLAY

CROSS REFERENCE TO RELATED APPLICATIONS

This application claims priority from U.S. Provisional Patent Application Ser. No. 60/443,651, filed on Jan. 30, 2003, the content and teachings of which are incorporated herein by reference.

BACKGROUND OF THE INVENTION

1. The Technical Field

The present invention relates generally to displays used in man/machine interfaces. More particularly, the present invention relates to integration of such displays into wiring boards, equipment panels and other substrates.

2. The Prior Art

Displays often are used to visually communicate information to a user of machines as diverse as coffee makers and industrial presses. Such displays can be embodied in many forms. For example, a simple display might take the form of one or more lights that illuminate selectively to indicate the status of a machine (e.g., energized, running, stopped). A more complex display might include one or more multi-segment or dot matrix elements for providing alphanumeric information (e.g., temperature, pressure, time). A conventional display typically is provided as a pre-manufactured component or sub-assembly for later mounting to a carrier or substrate, typically a printed wiring board or other component or panel of a machine. The substrate or carrier may include other include other electrical/electronic components, for example, proximity sensors.

Conventional displays can be complicated and expensive to build. Indeed, some applications might even require custom-made displays. This can make them unsuitable for low-cost applications. Also, conventional displays have a finite thickness. When mated to a machine panel or other substrate, even a relatively thin conventional display might be too thick for integration into an application requiring a low overall profile.

SUMMARY OF THE INVENTION

The present invention overcomes these and other shortcomings of the prior art by integrating a display into a component carrier or substrate, for example, a printed wiring board or panel of an apparatus in connection with which the display is to be used, thus obviating the need for a separate display component. Other components, such as sensors, can be integrated into the assembly, as well. Without limitation, sensors as described in U.S. Pat. No. 5,594,222, No. 6,310,611 and No. 6,320,282, the teachings of which are incorporated herein by reference, are well suited for such an application.

In a preferred embodiment, the substrate is of substantially uniform thickness and relatively thin compared to its length and width. However, the substrate may embody any other shape and cross section, as well. Thus, the first and second surfaces may be, but need not be, substantially parallel. The substrate typically would be embodied as a printed wiring board, but could be embodied in any other number of other forms. For example, the substrate could be an exterior panel of an appliance or the dash panel of an automobile.

In a preferred embodiment, the substrate defines one or more penetrations therethrough, each such penetration having a side wall, an entrance opening and an exit opening. The penetration can be of any regular or irregular shape, for example, round, square or elliptical, and it can be formed using any suitable molding, forming or machining technique, for example, NC drilling or punching, among others. A light source is associated with the entrance opening and is configured to selectively direct or otherwise admit light to the penetration through the entrance opening. Preferred light sources include lamps, LEDs, OLEDs, PLEDs, though others can be used, as well.

The penetration serves as a light guide. To this end, the side wall of the penetration preferably is coated with a reflective material, for example, white paint or a reflective metal, so that light introduced to the penetration is transmitted therethrough and not dissipated into the substrate. In other embodiments, the side wall could be coated with any substantially opaque material which precludes diffusion of light into the substrate. Further, the side wall could be left uncoated if the substrate were made of a material which does not substantially transmit light. In the foregoing embodiments, light entering the penetration at the entrance opening reflects off the side wall and exits the penetration at the exit opening.

Alternatively, the penetration serves as a housing for a light guide. In such a preferred embodiment, the penetration is substantially filled with a material having a high refractive index, for example, a light transmissive epoxy having good optical properties. In this embodiment, light entering the refractive material from the entrance opening reflects off the internal walls of the refractive material and exits the refractive material at the exit opening. Thus, the refractive material acts as a light guide. In another embodiment, a discrete light guide could be installed in the penetration.

In a preferred embodiment, a light diffuser is associated with the exit opening of the penetration. The diffuser diffuses light exiting the penetration to enhance readability of the display by the user. Such light diffuser typically would be embodied as a layer of light transmissive material applied over the exit opening.

In an alternate embodiment, the substrate defines one or more cavities, instead of (or in addition to) the foregoing penetrations. Each cavity includes a side wall and an entrance opening. Such cavities do not completely penetrate the substrate. Thus, each cavity includes a closed end instead of an exit opening. These cavities can be molded into the substrate or formed into the substrate using any suitable machining technique. In this embodiment, at least the portion of the substrate between the closed end of the cavity and the second surface of the substrate is transparent or translucent so that light may be transmitted therethrough. The side wall of the cavity preferably is coated in the manner discussed above to preclude light dispersion into the substrate.

Alternatively, the cavity can be filled with a refractive material, as discussed above. In this embodiment, the portion of the substrate between the closed end of the cavity and the second surface of the substrate performs the function of the light diffuser of the embodiment described above.

A display according to the invention can mimic conventional single element or multiple element displays. Typically, a single penetration or cavity would be used to mimic a single element display, such as a status indicator light, or the individual elements of a multiple element display. For example, seven penetrations or cavities arranged in the manner of a conventional seven-segment display could mimic such a conventional display. Other configurations are possible, as well. Further, any practical number of displays can be located on the same substrate. Thus, the present invention is well-suited to applications requiring multiple displays.

The substrate can include other components commonly present in man/machine interfaces, such as sensors and other electrical or electronic components. Integration of such components with the display can further reduce the cost, complexity, and size of an end component. The substrate also can include decoration, texture, and the like, for functional or purely decorative purposes.

DETAILED DESCRIPTION OF THE ILLUSTRATED EMBODIMENTS

Figure 1A:
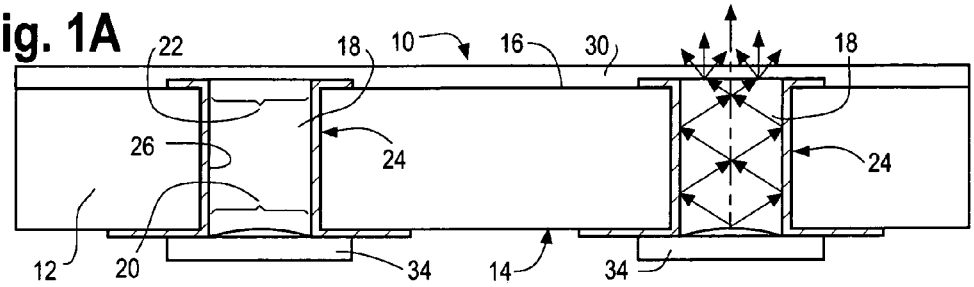
FIG. 1A is a cross-sectional view of an embodiment of the present invention.
Figure 1B:
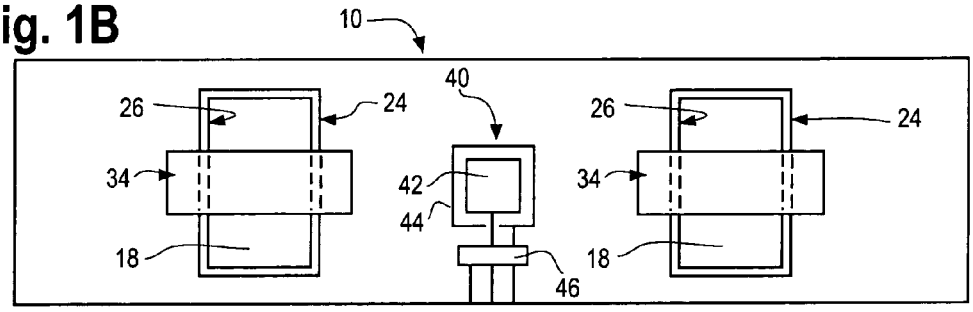
FIG. 1B is a top plan view of the apparatus illustrated in FIG. 1A.

FIGS. 1A and 1B illustrate a preferred embodiment of an integrated display 10 according to the present invention. Display 10 includes a substrate 12 having a first surface 14 and a second surface 16. Substrate 12 can be embodied as virtually any type of substrate, carrier, panel, etc. Although illustrated as planar and having uniform thickness, substrate 12 can take any virtually any other form. For example, it can have regularly or irregularly varying non-uniform thickness. It can be curved, rippled, or have any variety of complex shapes and cross-sections. In a typical embodiment, substrate 12 might be a printed wiring board, such as an FR4 board with a one-half ounce copper layer and an OSP or HASL finish. In other embodiments, substrate 12 could be an exterior panel of a domestic appliance, such as a coffee maker or washing machine, a dash panel or other interior panel of an automobile, or a panel of any other machine or piece of equipment. These are but a few examples of substrates into which a display can be integrated according to the present invention. Further, although first surface 14 and second surface 16 are illustrated as generally opposed, parallel surfaces, first and second surfaces 14 and 16 could be related in any number of other ways. For example, first and second surfaces 14 and 16 could be at right angles to each other.

Substrate 12, as illustrated in FIG. 1B, includes two rectangular penetrations 18. In other embodiments, substrate 12 may include more or fewer than two such penetrations, and such penetrations may be of any regular or irregular shape, including, without limitation, circular, square, elliptical or free form. Penetrations 18 may be formed by drilling, molding, punching, or other suitable techniques. Each penetration 18 includes an entrance opening 20, an exit opening 22 and a side wall 24.

Penetrations 18 function as light guides or housings for light guides. Light is coupled from a light source into entrance opening 20. The light reflects off of the internal walls of the light guides so that the light ultimately leaves the light guide at the exit opening.

Figure 2:
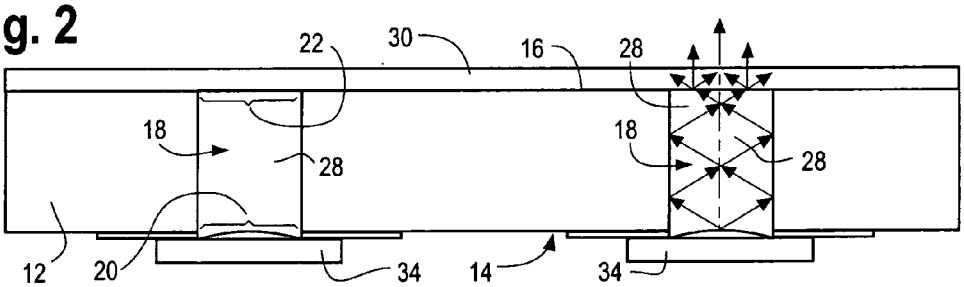
FIG. 2 is a cross-sectional view of an alternate embodiment of the present invention.

In a preferred embodiment, as illustrated in FIG. 1A, penetrations 18 function as light guides. In order to best enable penetration 18 to function as a light guide, side wall 24 preferably is impervious to light transmission to prevent light dissipation or diffusion through substrate 12. To this end, side wall 24 preferably is plated with a reflective coating 26, as shown in FIG. 1A. In alternate embodiments, side wall 24 can be coated with, for example, white paint or other non-transparent materials. Conceivably, side wall 24 could be left uncoated. In such an embodiment, substrate 12 preferably would be made of a material which inherently reflects light or does not substantially transmit light because such materials would tend to reduce light dissipation through the substrate. In an alternate embodiment, as illustrated in FIG. 2, penetrations 18 function as housings for light guides. In this embodiment, penetrations 18 are filled with an epoxy material 28 having a high refractive index, with the epoxy material comprising the light guide. Such material allows light transmission though penetrations 18, from the first side to the second side of substrate 12, but prevents or retards light dispersion into substrate 12. Other materials having desirable optical, mechanical and electrical properties can be used in lieu of epoxy 28. In another embodiment, not shown in the drawings, a discrete light guide, such as a light pipe could be installed in penetration 18. In the foregoing embodiments, side wall 24 can be, but need not be coated as described above in connection with the FIG. 1A embodiment. A separate light pipe assembly with apertures built into it could serve as the light guide in a similar fashion.

A display according to the present invention can include a diffuser 30 located at or near exit opening 22. The purpose of diffuser 30 is to diffuse light exiting penetration 18 which might otherwise be channelized, thus enhancing readability of the display by the user. To this end, diffuser 30 can be made of any variety of light transmissive materials. In preferred embodiments, diffuser 30 can cover a substantial portion of second surface 16, as shown in FIGS. 1A and 2, or it can simply cover a smaller portion of second surface 16 proximate exit opening 22. Diffuser 30 can include printing or other decoration (not shown) to enhance the functionality of the display (and of any other components associated with the substrate), or for purely decorative purposes. Diffuser 30 can be embodied as, for example, a fascia, an overlay, a piece of glass, or any other structure that aids in diffusing light exiting penetration 18. Display 10 further includes a light source 34 adapted to introduce light to entrance opening 20, as shown in FIGS. 1A, 1B and 2. Preferably, light source 34 takes the form of a low profile LED mounted to first surface 14 of substrate 12, proximate entrance opening 20. In other embodiments, light source 34 could be a lamp, an EL, OLED, PLED, vacuum fluorescent or light source. Although light source LED is illustrated in a particular orientation with respect to penetration 18, other orientations are possible, as well.

Figure 3:
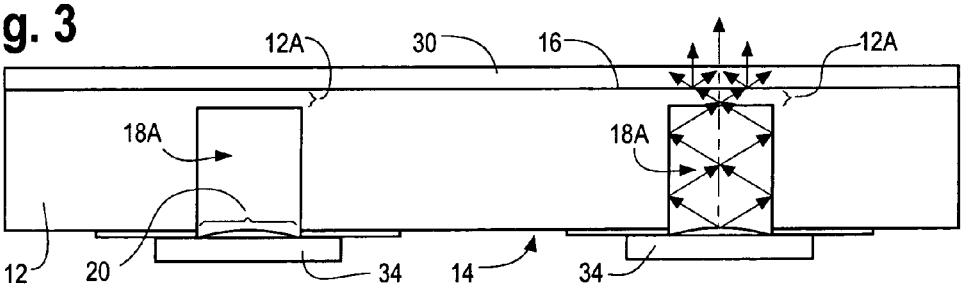
FIG. 3 is a cross-sectional view of another alternate embodiment of the present invention.

In another embodiment illustrated in FIG. 3, substrate 12 defines one or more cavities 18A in lieu of (or in addition to) penetrations 18. Cavities 18A are similar to and provide essentially the same function as penetrations 18, except that cavities 18A do not completely penetrate substrate 12. Instead, a thin layer of substrate material 12A remains where exit opening 22 is located in the FIGS. 1A and 2 embodiments. Thus, each cavity 18A includes an entrance opening 20, a side wall 24 and a closed end 32. Side wall 24 of cavity 18A can be coated with a reflective or other non-transparent material (not shown), as discussed above, so that cavity 18A can function as a light guide. Alternatively, cavity 18A can be filled with a refractive material (not shown), as discussed above, which can function as a light guide. In such embodiments, at least thin layer of substrate material 12A is transparent or translucent so that light may be transmitted therethrough and be visible to the user. Thus, thin layer of substrate material 12A can function as a diffuser, obviating any need for a separate diffuser, such as diffuser 30 as illustrated in FIGS. 1A and 2 and described above. Notwithstanding, a separate diffuser 30 may be layered or screen-printed on surface 16.

Figure 4:
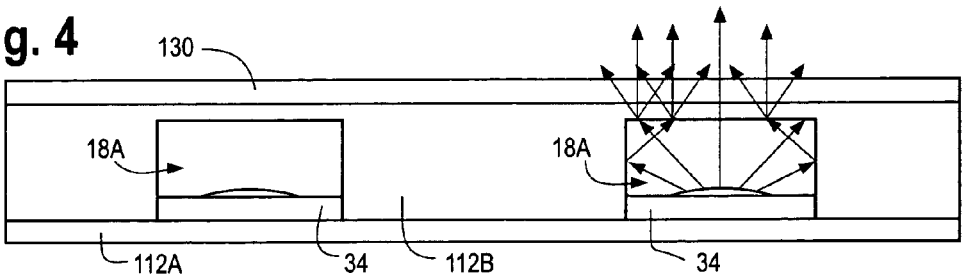
FIG. 4 is a cross-sectional view of a further embodiment of the present invention.

In another alternate embodiment, illustrated in FIG. 4, the light source is disposed on a carrier, for example, a printed wiring board, separate from the substrate comprising the light guide. Here, light sources 34, for example, surface mount LEDs, are disposed on carrier 112A, which can include other components, such as sensors, as discussed above. Substrate 112B includes cavities 18A, as discussed above. In other embodiments, substrate 112B could include penetrations in addition to or in lieu of cavities 18A. Carrier 112A is attached to substrate 112B using adhesives or other suitable attachment means such that light sources 34 mounted on carrier 34 are substantially aligned with cavities 18A (and/or penetrations) in substrate 112B. An optional diffuser 130 can be attached to the viewed surface (here, the opposing surface) of substrate 112B, as described above.

In practice, a seven-segment display could be constructed by tooling (such as by punching or NC drilling) or molding a substrate (such as a printed wiring board) with penetrations corresponding to the seven segments, plating the side walls of the penetrations using known plating techniques, and attaching a suitable light source (such as a surface-mount LED of appropriate color) proximate the entrance opening of each penetration using a suitable technique (such as a reflow-solder technique, using known surface-mount component process equipment), opposite the exit opening and any diffuser or fascia that might be located proximate the exit opening. Other user interface components (such as sensors or other components) could be mounted to the substrate at the same time or as a step during the same production process, thus reducing overall manufacturing cost and yielding an interface of smaller size than could be manufactured using conventional discrete components. For example, a sensor 40 can be mounted on the first surface 14 of substrate 12, as shown in FIG. 1B. A sensor could be mounted on other portions of display 10 as well. The illustrated sensor 40 includes a first electrode 42, a second electrode 44, and an active component or integrated circuit 46. Other types of sensors or components could be used instead of or in addition to the illustrated sensor. In another embodiment, the penetrations could be filled with a material, such as an epoxy, having an appropriate refractive index, in lieu of plating. In further embodiment, the substrate could be tooled or molded with cavities instead of penetrations, the penetrations could be filled with a refractive material or the side walls thereof could be plated.

The present invention is limited only by the following claims and not the foregoing embodiments. One skilled in the art would know to make certain modifications to the foregoing embodiments without departing from the scope of the claims.

We claim:

1. An integrated low profile display apparatus, comprising:

a substrate having a first surface and a second surface;

said substrate defining at least one penetration extending through said substrate from said first surface to said second surface;

each said penetration having a side wall, an entrance opening defined by said first surface, and an exit opening defined by said second surface;

at least one light emitting device; and a light diffuser associated with said exit opening of said penetration;

each said light emitting device mounted to said first surface of said substrate proximate the entrance opening of a corresponding penetration and adapted to selectively admit light to said penetration via said entrance opening; and each said light emitting device being electrically connected to a corresponding electrical conductor attached to said first surface of said substrate.

2. The apparatus of claim 1 wherein said substrate is of substantially uniform thickness.

3. The apparatus of claim 1 wherein said substrate is of varying cross-section.

4. The apparatus of claim 1 wherein said substrate comprises a printed wiring board.

5. The apparatus of claim 1 wherein said substrate comprises a user interface panel.

6. The apparatus of claim 1 wherein said side wall is covered with a substantially opaque material.

7. The apparatus of claim 6 wherein said substantially opaque material is a reflective material.

8. The apparatus of claim 7 wherein said reflective material is a paint.

9. The apparatus of claim 7 wherein said reflective material is a reflective coating.

10. The apparatus of claim 1 further comprising a light guide within said penetration.

11. The apparatus of claim 10 wherein said light guide comprises a material having a high index of refraction.

12. The apparatus of claim 11 wherein said material having a high index of refraction comprises a light transmissive epoxy.

13. The apparatus of claim 10 wherein said substrate comprises a substantially opaque material.

14. The apparatus of claim 10 wherein said substrate comprises a material substantially impervious to light transmission.

15. The apparatus of claim 1 wherein a plurality of said at least one penetrations are arranged to form a multiple element display.

16. The apparatus of claim 1 wherein said diffuser comprises a layer of light transmissive material applied over said exit opening.

17. The apparatus of claim 1 wherein said light emitting device comprises a light emitting diode.

18. The apparatus of claim 1 wherein said light emitting device comprises a lamp.

19. The apparatus of claim 1 wherein said light emitting device comprises an OLED.

20. The apparatus of claim 1 wherein said light emitting device comprises a PLED.

21. The apparatus of claim 1 wherein said display comprises a single element defined by a single penetration.

22. The apparatus of claim 1 wherein said display comprises plural elements defined by plural penetrations.

23. The apparatus of claim 1 further comprising at least one electronic component mounted on said substrate.

24. The apparatus of claim 23 wherein said electronic component comprises a sensor.

25. The apparatus of claim 24 wherein said sensor comprises at least a first electrode disposed on said substrate.

26. The apparatus of claim 25 wherein said sensor further comprises a second electrode disposed on said substrate.

27. The apparatus of claim 25 wherein said sensor further comprises an active component electrically coupled to said first electrode.

28. The apparatus of claim 25 wherein said sensor further comprises an integrated control circuit electrically coupled to said first electrode.

29. An integrated low profile display apparatus, comprising:

a substrate having a first surface and a second surface;

said substrate defining at least one cavity;

said cavity having a substantially opaque side wall, an entrance opening defined by said first surface, and a closed end; and at least one light emitting device;

each said light emitting device mounted to said first surface of said substrate proximate the entrance opening of a corresponding cavity and adapted to selectively admit light to said cavity via said entrance opening, and each said light emitting device electrically coupled to an electrical conductor attached to said first surface of said substrate.

30. The apparatus of claim 29 wherein said substrate is of substantially uniform thickness.

31. The apparatus of claim 29 wherein said substrate is of varying cross-section.

32. The apparatus of claim 29 wherein said substrate comprises a printed wiring board.

33. The apparatus of claim 29 wherein said substrate comprises a user interface panel.

34. The apparatus of claim 29 wherein said side wall is covered with a substantially opaque material.

35. The apparatus of claim 34 wherein said substantially opaque material is a reflective material.

36. The apparatus of claim 35 wherein said reflective material is a paint.

37. The apparatus of claim 35 wherein said reflective material is a reflective coating.

38. The apparatus of claim 29 further comprising a light guide within said cavity.

39. The apparatus of claim 38 wherein said light guide comprises a material having a high index of refraction.

40. The apparatus of claim 39 wherein said material having a high index of refraction comprises a light transmissive epoxy.

41. The apparatus of claim 38 wherein said substrate comprises a substantially opaque material.

42. The apparatus of claim 38 wherein said substrate comprises a material substantially impervious to light transmission.

43. The apparatus of claim 29 further comprising a light diffuser associated with said closed end of said cavity.

44. The apparatus of claim 43 wherein said diffuser comprises a layer of light transmissive material applied over said closed end of said cavity.

45. The apparatus of claim 29 wherein said light emitting device comprises a light emitting diode.

46. The apparatus of claim 29 wherein said light emitting device comprises a lamp.

47. The apparatus of claim 29 wherein said light emitting device comprises an OLED.

48. The apparatus of claim 29 wherein said light emitting device comprises a PLED.

49. The apparatus of claim 29 wherein said display comprises a single element defined by a single cavity.

50. The apparatus of claim 29 wherein said display comprises plural elements defined by plural cavities.

51. The apparatus of claim 29 further comprising at least one sensor mounted on said substrate.

52. The apparatus of claim 51 wherein said sensor comprises at least a first electrode disposed on said substrate.

53. The apparatus of claim 52 wherein said sensor further comprises a second electrode disposed on said substrate.

54. The apparatus of claim 52 wherein said sensor further comprises an active component electrically coupled to said first electrode.

55. The apparatus of claim 52 wherein said sensor further comprises an integrated control circuit electrically coupled to said first electrode.

56. The apparatus of claim 1 wherein a plurality of said at least one penetrations are arranged to form a seven-segment display.

57. The apparatus of claim 29 wherein a plurality of said at least one cavities are arranged to form a multiple element display.

58. The apparatus of claim 29 wherein a plurality of said at least one cavities are arranged to form a seven-segment display.

* * * * *